US009781981B2

(12) United States Patent
Fukuyama et al.

(10) Patent No.: US 9,781,981 B2
(45) Date of Patent: Oct. 10, 2017

(54) STOP FOR A SLIDE FASTENER, AND A METHOD FOR THE MANUFACTURE THEREOF

(75) Inventors: Takahiro Fukuyama, Toyama (JP); Yusuke Meiwa, Toyama (JP); Hayato Ishii, Vercelli (IT); Futoshi Kozato, Vercelli (IT); Takuro Hayashi, Ascoli Piceno (IT); Massimiliano Di Girolami, Ascoli Piceno (IT); Masamichi Yamagata, Vercelli (IT)

(73) Assignee: YKK Corporation (JP)

( * ) Notice: Subject to any disclaimer, the term of this patent is extended or adjusted under 35 U.S.C. 154(b) by 100 days.

(21) Appl. No.: 14/234,564

(22) PCT Filed: Jul. 20, 2012

(86) PCT No.: PCT/EP2012/064344
§ 371 (c)(1),
(2), (4) Date: Jan. 23, 2014

(87) PCT Pub. No.: WO2013/014108
PCT Pub. Date: Jan. 31, 2013

(65) Prior Publication Data

US 2014/0150216 A1 Jun. 5, 2014

(30) Foreign Application Priority Data

Jul. 27, 2011 (WO) ..... PCT/EP2011/062952

(51) Int. Cl.
*A44B 19/36* (2006.01)
*A44B 19/26* (2006.01)
(Continued)

(52) U.S. Cl.
CPC ..... *A44B 19/36* (2013.01); *A44B 19/26* (2013.01); *A44B 19/60* (2013.01); *B21F 45/18* (2013.01); *Y10T 24/2598* (2015.01)

(58) Field of Classification Search
CPC ..... A44B 19/36; A44B 19/26; A44B 19/60; B21F 45/18; Y10T 24/2598
See application file for complete search history.

(56) References Cited

U.S. PATENT DOCUMENTS 2,884,691 A 5/1959 Rath et al.
2,951,285 A * 9/1960 Law ..... A44B 19/36 24/435
2008/0115337 A1 5/2008 Ohgaku

FOREIGN PATENT DOCUMENTS

EP 0237068 A1 9/1987
EP 2363035 A1 9/2011
(Continued)

OTHER PUBLICATIONS

Office Action, Japanese Patent Application No. 2014-522049, dated Mar. 31, 2015.
(Continued)

*Primary Examiner* — Robert J Sandy
*Assistant Examiner* — Louis Mercado
(74) *Attorney, Agent, or Firm* — Kilpatrick Townsend & Stockton LLP

(57) ABSTRACT

There is provided a stop for a slide fastener. A top plate and a bottom plate are linked with one another at a transversely intermediate position by an integral connecting post. The lower side of the top plate is substantially flat. The bottom plate slopes away from the connecting post to form two leg members provided with a respective end flange pointing towards the top plate, the leg members being adapted to cooperate in use with the top plate to retain fastener tapes therebetween.

15 Claims, 9 Drawing Sheets

(51) Int. Cl.
*B21F 45/18* (2006.01)
*A44B 19/60* (2006.01)

(56) References Cited

FOREIGN PATENT DOCUMENTS

| | | | |
|---|---|---|---|
| JP | S54-146143 | A | 11/1979 |
| JP | S58-098810 | A | 7/1983 |
| JP | 2008-068110 | A | 3/2008 |
| JP | 2008-125737 | A | 6/2008 |

OTHER PUBLICATIONS

International Search Report and Written Opinion, PCT Application No. PCT/EP2012/064344, dated Dec. 14, 2012.

* cited by examiner

STOP FOR A SLIDE FASTENER, AND A METHOD FOR THE MANUFACTURE THEREOF

This application is a national stage application of PCT/EP2012/064344, which claims priority to PCT/EP2011/062952, both of which are incorporated herein by reference.

FIELD OF THE INVENTION

The present invention relates to a stop for a slide fastener, for stopping the sliding of a slider thereof.

More specifically, the invention relates to a stop for a slide fastener, comprising a top plate and a bottom plate linked with each other at a transversely intermediate position by a connecting post, the stop being intended to be crimped onto side portions of fastener tapes provided with respective cores or cords.

The invention also relates to a slide fastener to which such a stop is attached, and a method for the manufacture of such stops.

In the present description and the annexed claims reference is made to a stop having a top plate and a bottom plate. By "top" plate and "bottom" plate are herein meant the plate members of a stop which in use in a garment or the like face the outside and the inside thereof, respectively.

In the following, reference will also be made to a "top edge" and a "bottom edge" of the stop, and in particular of the top plate thereof, to indicate the edges which in use are essentially perpendicular to the direction of displacement of the slider. In particular, the "top edge" is the edge facing the fastener elements or teeth and the "bottom edge" is that facing in the opposite direction.

RELATED PRIOR ART

US patent application No. US 2008/0115337 A1 discloses bottom end stops for slide fasteners having rather complicate shapes, wherein the lower side of the top plate is provided with flanges pointing towards the bottom plate, and the upper side of the bottom plate is similarly provided with flanges pointing towards the top plate.

In a first embodiment disclosed in said prior US application the lower side of the top plate is provided further with projections pointing downwards toward corresponding projections which protrude upwards from the upper side of the bottom plate.

Such prior stops for slide fasteners can be typically manufactured by die casting.

In a second embodiment disclosed in said US application the top plate has an upper flat surface adapted to be provided with a decoration, such as letters, marks and/or designs.

In all the stops disclosed in said US patent application the lower side of the bottom plate, which in use is on the inside of, for instance, a garment, has an overall surface which is quite uneven and marked by a deep central groove, which may prevent the stop from being felt as smooth.

A first object of the present invention is to provide a stop for a slide fastener which has a quite simpler cross-sectional shape, though ensuring a remarkable holding strength.

A second object of the invention is to provide a stop for slide fasteners which feels smoother in use, for instance when used in a garment or the like.

A third object of the invention is to provide a stop which permits the automatical detection of the longitudinal orientation thereof.

A fourth object of the invention is to provide a slide fastener with an improved stop.

A fifth object of the present invention is to propose an improved method for the manufacture of such stops.

A still further object of the present invention is to provide a method for detecting whether a bottom stop is correctly oriented in view of its attachment to the tapes of a slide fastener.

SUMMARY OF THE INVENTION

The above-mentioned first object is achieved according to the invention by a stop comprising

- a top plate and a bottom plate linked with each other at a transversely intermediate position by a connecting post, wherein
- the lower side of the top plate is substantially flat, and
- the bottom plate slopes away from said connecting post to form two leg members provided with respective end flanges pointing towards the top plate, said leg members being adapted to cooperate with the top plate to retain fastener tapes therebetween.

Such a stop has a quite simple cross-sectional shape, which allows the manufacture of a plurality of stops by shaping a blank wire member by pressure rolling, and subsequently cutting the shaped wire member to the desired size of the stops.

The above-mentioned second object is achieved according to the invention by a stop as defined above, wherein the bottom plate is shaped such that in the condition of use also the lower side thereof is substantially flat.

Thus, since also the lower side of the bottom plate of the stop is in use substantially flat, the stop as a whole is pleasantly perceived as completely smooth According to an aspect of the invention the upper side surface of the top plate is substantially flat, allowing a decoration, such as a logo or a design, to be applied thereto.

According to another aspect of the invention, the proximal portion of each leg member of the bottom plate forms a convex protrusion adjacent the connecting post.

Such a configuration allows the avoidance of the formation of gaps between the core (cord) of the fastener tapes and the connecting post in the tape-accommodating receptacles defined by the top and bottom plates and said post. Thus, the tape edges can be more securely and tightly encompassed therein.

According to a still further aspect of the invention the upper side of each leg member of the bottom plate has a sloping surface extending from the respective flange towards a proximal portion of the leg member.

This configuration allows the avoidance of any weakening of the crimped tape edges when in use, providing resistance against the stresses to which the fastener tapes are subjected and which tend to pull them out of the stop.

As anticipated above, according to an important aspect of the present invention the stop can be conveniently formed by pressure rolling a blank wire member, though it is also possible to manufacture such stops by conventional die casting techniques.

The above-mentioned third object is achieved according to the present invention by a bottom stop having an uneven member formed on a surface below the upper surface of the top plate, allowing to distinguish established top and bottoms edges of the top plate of the stop.

Such an uneven member, which can be a recess or a protrusion, can be formed for instance in an edge position of one end of the stop, preferably in the bottom plate thereof, and more preferably centrally in said bottom plate, on the side of the latter opposed to the connecting post.

Such an uneven member can be conveniently provided with a sloping surface inclined with respect to a predetermined direction, and capable of being easily detected, for instance by means of a CCD camera, to detect whether the bottom stop is correctly oriented in view of its attachment to the tapes of a slide fastener.

The above-mentioned fourth object is achieved according to the present invention by a slide fastener of a per se known design, to which a stop according to the invention is attached, wherein the lower side of the top plate of the stop is substantially flat and the leg members of the bottom plate cooperate with the top plate to retain fastener tapes therebetween.

The above-mentioned fifth object is achieved according to the invention by a method for forming a plurality of stops, comprising pressure rolling a blank wire member into a desired cross-sectional shape, and cutting the rolled wire member to the size of the stops.

The above-mentioned still further object is achieved according to the invention by a method according to which an uneven member is formed in a rear side portion of the bottom stop, and said rear side portion is automatically scanned to detect said uneven member, to provide signals allowing to determine whether the top and bottom edges of the stop are disposed in a predetermined relative position.

Such a method is particularly useful to assess whether a stop member provided with a design or logo which is asymmetrical with respect to a transverse horizontal axis is correctly oriented in view of its attachment to the fastener tapes.

BRIEF DESCRIPTION OF THE DRAWINGS

Further objects, features, aspects and advantages of the present invention will become apparent from the following description, provided purely by way of a non-limiting example, with reference to the accompanying drawings, wherein.

DESCRIPTION OF PREFERRED EMBODIMENTS

Figure 1:
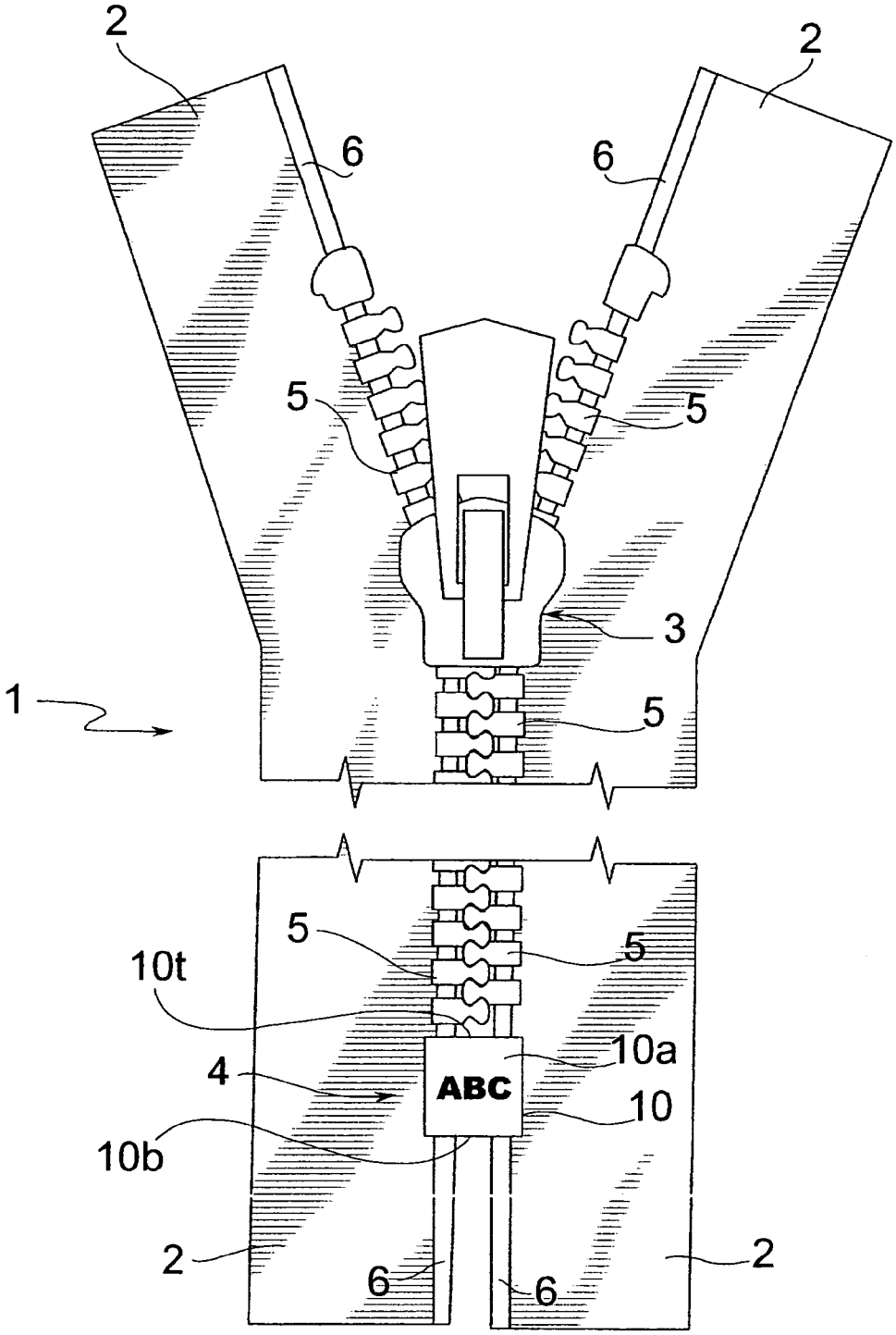
FIG. 1 is a partial top-plan view of a slide fastener provided with a stop according to the present invention.

The present invention relates to an end stop. Though in the drawings only a bottom stop can be seen, stops according to the invention could be used in a closed slide fastener which has stops at both ends, if desired.

Figure 2:
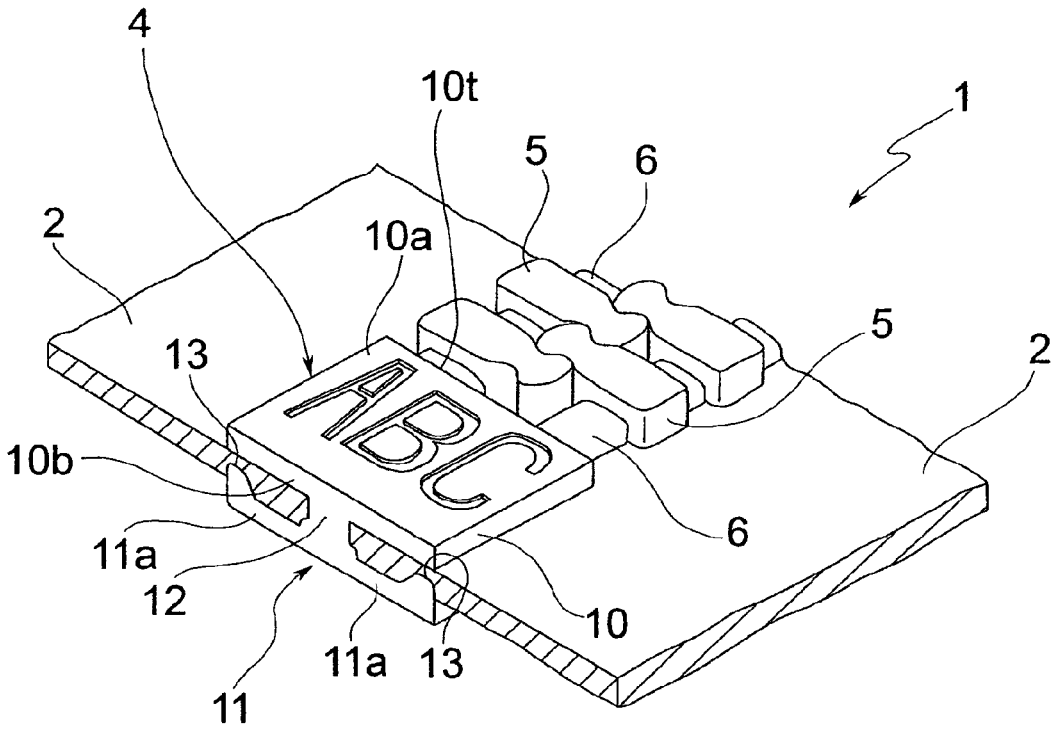
FIG. 2 is a partial perspective view, showing a stop according to the present invention applied to the tapes of a slide fastener.

In FIGS. 1 and 2 there is shown a slide fastener 1, of a per se known kind, comprising a pair of fastener stringers, a slider 3, and a bottom end stop 4.

The fastener stringers comprise respective tapes 2 having a plurality of fastener elements or teeth 5 attached on one side edge in the length direction.

The slider 3 allows the fastener elements 5 to pass therethrough, whereby the slider slides on said elements 5 to engage/disengage them.

The bottom end stop 4 is located on the bottom end side of the slide fastener 1 and is attached adjacent to the lowermost fastener elements 5. Said bottom end stop 4 prevents the slider 3 from slipping away downwards from the fastener elements 5.

The fastener elements 5 are constituted of individual elements fixed at predetermined pitches in the length direction of the slide fastener 1. As a preferable example, the fastener elements 5 may be of single unit type, or continuous linear zigzag type, and the material thereof may be metal or resin.

The bottom end stop 4 is made of metal, and is attached by crimping to a core portion 6 formed on one side edge of the fastener tapes 2.

Figure 3:
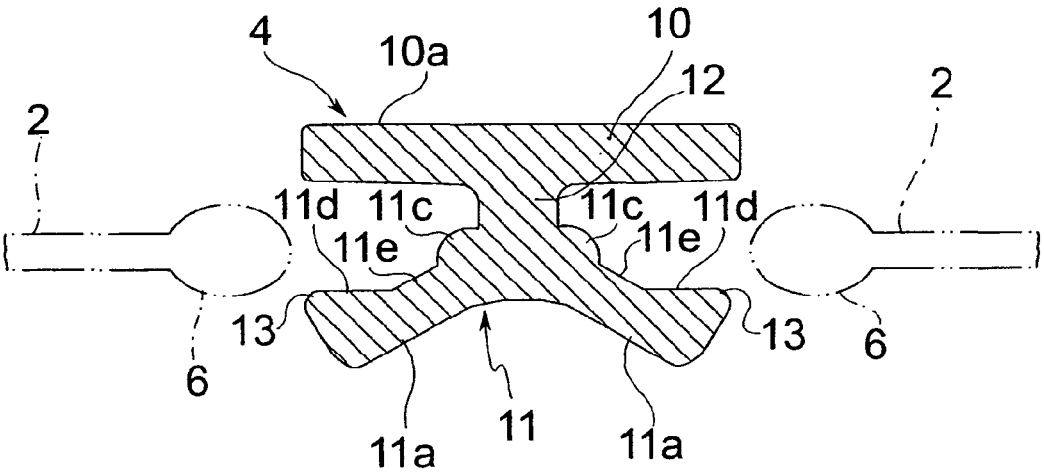
FIG. 3 is a transverse sectional view of a stop according to the present invention, shown before being crimped onto the tapes of a slide fastener.
Figure 4:
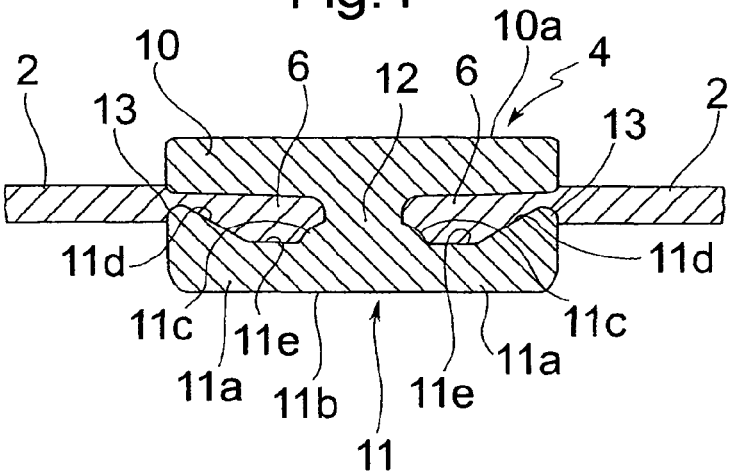
FIG. 4 is a transverse sectional view showing the stop of FIG. 3 after being crimped onto the tapes of a slide fastener.

Referring to FIGS. 2 to 4, a stop 4 according to the present invention comprises a top plate 10 and a bottom plate 11, linked with one another at a transversely intermediate position by a connecting post or stem 12.

Preferably, the upper side surface 10*a* of the top plate 10 is substantially flat.

Conveniently, the upper surface 10*a* of the stop 4 can be provided with a decoration, such as letters, marks, logos and designs. Such a decoration can be stamped or otherwise impressed onto the stop 4 during the manufacturing process.

Laser engraving can also be used as a technique for providing said decoration on the top plate 10 of the stop 4.

Figure 5:
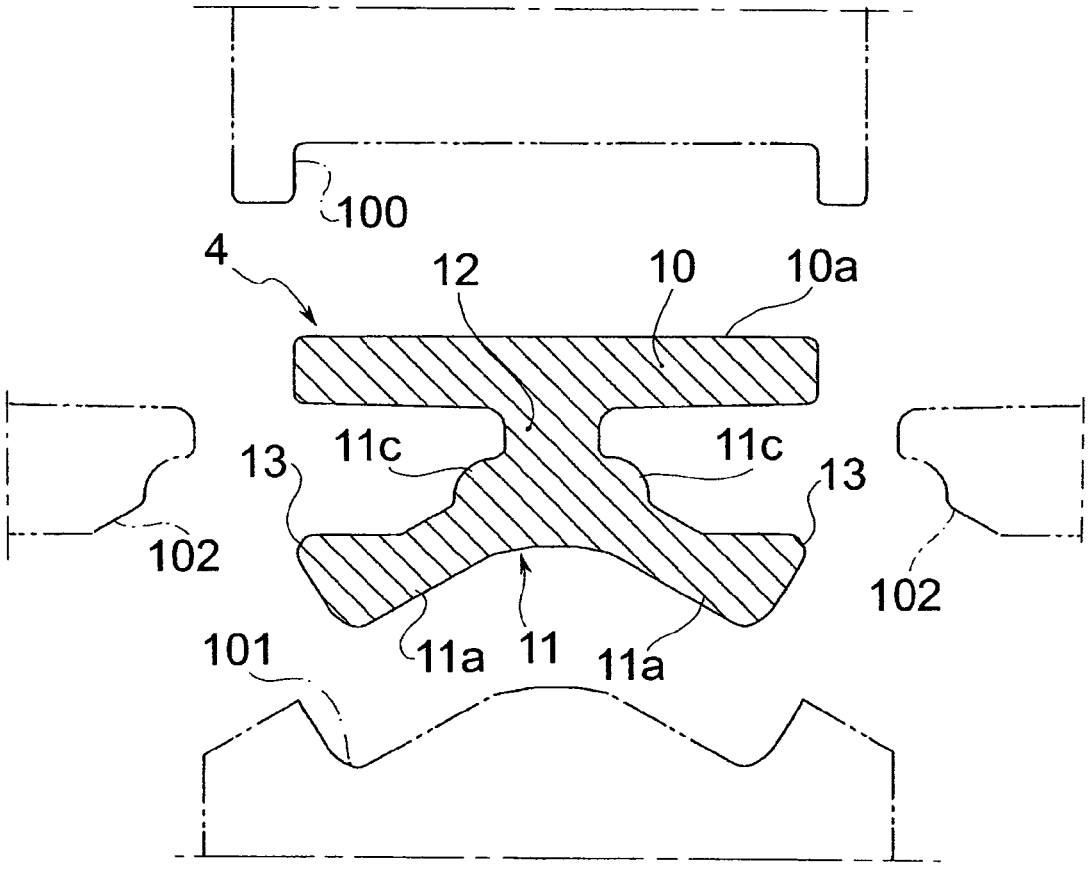
FIG. 5 shows a diagrammatical representation of apparatus for pressure rolling a wire member, for the manufacture of stops according to the present invention.

As can be seen in particular in FIGS. 3 and 5, the bottom plate 11 slopes downwards away from the connecting post 12 to form two leg members 11*a* provided with respective flanges 13 pointing upwards towards the top plate 10.

The leg members 11*a* are deformable from their edges in the direction of the top plate 10, to crimp the cores 6 of the fastener tapes 2 therebetween as shown in FIGS. 2 and 4.

Prior to the application to the fastener tapes the bottom plate 11 of the stop 4 is shaped such that after being deformed or "closed", i.e. in the condition of use, the lower side surface 11*b* thereof is also substantially flat as shown in FIGS. 2 and 4.

The stop 4 can be attached to the fastener tapes 2 without deforming the top plate 10 thereof which possibly bears a decoration, and by applying pressure solely to the shaped leg members 11*a*.

Thanks to the fact that in the condition of use both the upper surface 10*a* and the lower surface 11*b* of the stop 4 are substantially flat, the stop 4 as a whole is pleasantly perceived as relatively smoother than the stops according to the prior art. Such a smooth feel is particularly of interest in connection with the lower side surface 11*b* of the bottom plate 11, which in use in a garment or the like will be on the inside thereof.

As anticipated above, the lower surface of the top plate 10 is essentially flat, said lower surface having no flanges protruding towards the bottom plate 11. This feature requires less material and makes the manufacture of the stop more straightforward.

Since the top plate 10 is not bent during the attaching process of the stop, the decoration possibly provided on the upper surface thereof is protected and consistent.

Referring once again to FIGS. 3 and 4, the proximal portion of each leg member 11*a* forms a convex protrusion 11*c* adjacent the connecting post 12. Said protrusion 11*c* is formed on the upper side of each leg member 11*a*, at the place where the leg member starts to sprout from the connecting post 12.

As can be seen in particular in FIG. 4, when the stop 4 is attached to the cores 6 of the tapes 2, said cores 6 are moved downwards, somewhat out of the plane of the fastener.

Since the cores 6 of the tapes 2 are substantially circular in shape, in the absence of the protrusions 11*c* gaps could be formed between the connecting post 12 and said cores 6. The protrusions 11*c* substantially "fill" such possible gaps, holding the cores 6 in position better, and supporting the rest of the leg members 11*a* when attempts are made to pull the tapes 2 out of the stop 4.

As already mentioned above, on the extremity of the leg members 11*a* there is provided a respective flange 13 which points upwards towards the upper plate 10, to hold the corresponding core 6 and tape 2 in place. The top of each flange 13 joins with the relevant protrusion 11*c* through two adjacent, essentially flat surfaces 11*d* and 11*e*.

Surface 11*e* is the lowest or bottom surface, substantially parallel with the lower surface 11*b* of the relevant leg member 11*a*.

In the deformed condition of use of the stop 4 shown in FIG. 4, the surface 11*d* stretches from the flange 13 in a flat sloping surface which joins with surface 11*e* in a continuous manner, the latter being essentially parallel with the top plate 10 and the bottom plate 11 of the stop 4.

The protrusion 11*c* is at the intersection of the base of the connecting post 12 and surface 11*e*.

As a whole, the surface of the protrusion 11*c* and the essentially flat surfaces 11*d* and 11*e* define a sort of groove having a substantially trapezoid transverse profile. This trapezium-like profile encircles the deformed core 6 of the corresponding tape 2, cooperating to ensure that no free gaps are left around it, reducing movement and ensuring a stronger grip.

A distinguishing feature of the stop according to the present invention is that its transverse profile allows the manufacture thereof by properly shaping, in a pressure rolling process, a blank wire. This technique allows easier control of the quality of the metal, avoiding any local weaknesses in the product which, with conventional techniques like die casting, may be occasioned by cracking due to the need to heat and cool the metal.

With reference to FIG. 5, by means of per se known pressure rolling apparatus a blank metal wire can be continuously shaped so as to assume a final cross-sectional profile corresponding to that of a stop according to the present invention prior to its crimping onto the fastener tapes.

Such a plastic deformation can be carried out using properly shaped rollers, such as the upper and lower rollers 100, 101 and the side rollers 102, partially and diagrammatically shown in FIG. 5.

The result of such a pressure rolling process is a continuous bar 200 (FIG. 6) having the transverse cross section of the desired stop prior to application to the fastener tapes.

Such a rolled wire member or bar 200 can thereafter be cut to the size of the stops, so as to obtain therefrom a plurality of stops 4.

With a view to facilitating and improving the pressure rolling process, care is taken that there are only smooth surfaces in the stop 4, ensuring that the rolled wire member comes freely out of the pressure roller assembly. With reference to FIG. 5, it can be appreciated that the upper and lower surfaces of the top plate 10 are substantially flat, with no flanges or other protrusions. Furthermore, the sloping surface is essentially parallel or at a small angle with respect to the plane of the lower surface of the top plate 10.

If the stops 4 obtained by the above-described method are to be provided with a decoration on the top plate 10 thereof, such a decoration can be engraved or otherwise provided on the top surface of the bar 200, before cutting it into a plurality of individual stops.

As an alternative, the individual stops 4 could be provided with the respective decoration after being cut from the bar 200.

Another embodiment of a bottom stop according to the present invention will be now described with reference to FIGS. 7 and 11.

Figure 6:
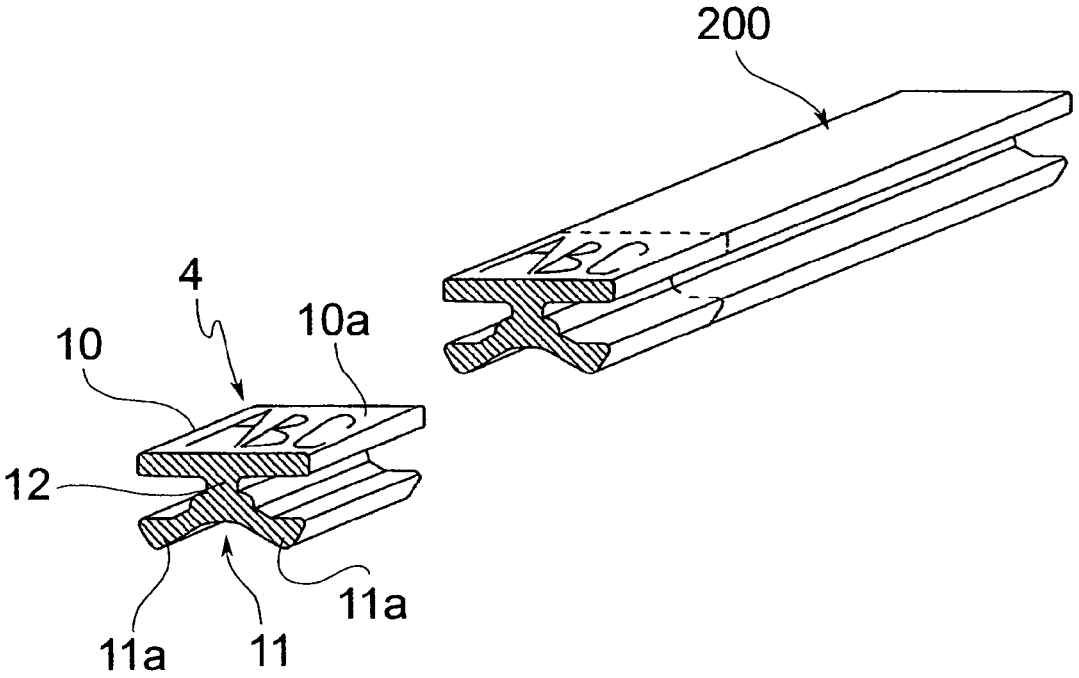
FIG. 6 is a perspective view illustrating a cutting operation of a pressure-rolled wire member to form a plurality of stops in a method according to the invention.
Figure 7:
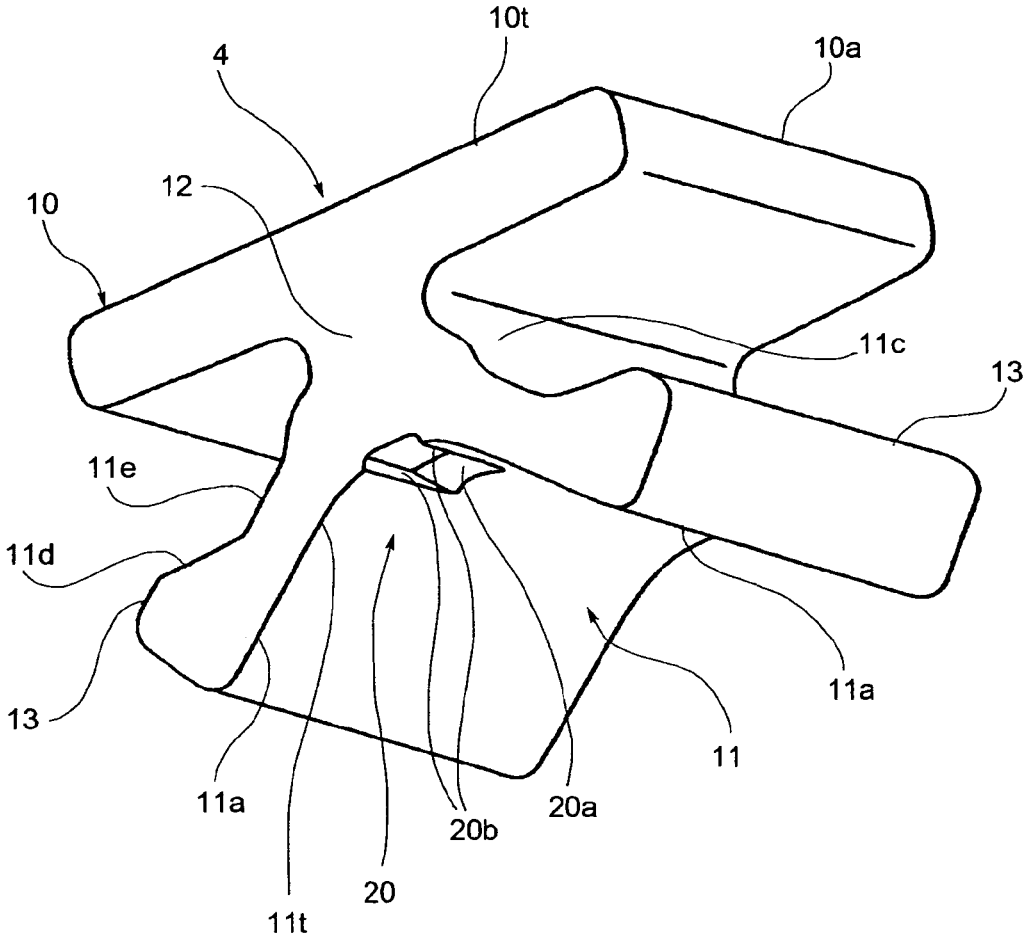
FIG. 7 is a perspective bottom view of an alternative embodiment of stop according to the present invention.
Figure 11:
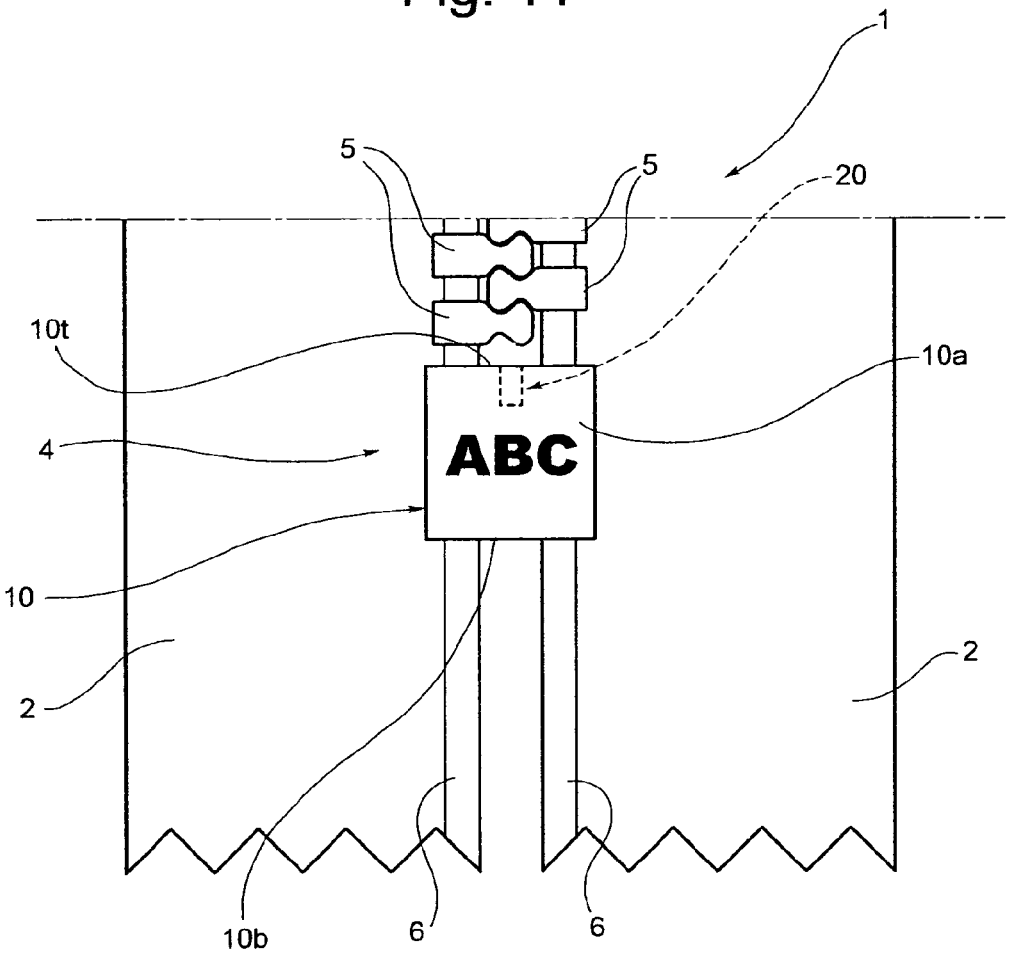
FIG. 11 is a partial top-plan view of a slide fastener provided with a bottom stop according to FIGS. 7 and 9.

In FIGS. 7 and 11 parts which have already been described in connection with FIGS. 1-6 have been attributed again the same reference numerals previously utilized.

The bottom stop 4 shown in particular in FIG. 7 represents a further improvement allowing the automatical detection of an established "top" and "bottom" for the stop.

When a stop 4 is (or is to be) provided with a logo and/or design on its top surface or front face 10*a*, if the logo and/or design is symmetrical about the horizontal axis, distinguishing the top and bottom edges of the front face of the stop may be not particularly important.

However, when this is not the case, it becomes necessary to establish the direction in which the stop 4 should face before it is attached to the fastener tapes.

The embodiment which will be now described with reference to FIG. 7-11 aims to solving that problem.

The bottom stop 4 shown in FIG. 7 is provided in a rear side portion thereof with a formation 20, shaped and positioned such as to allow the differentiation of the top edge 10*t* of the front face 10*a* of the top plate 10 from the bottom edge 10*b* of the same.

With reference for instance to FIG. 11, by the top edge 10*t* of the front face 10*a* it is meant herein the edge of said face 10*a* which is adjacent the fastener elements or teeth 5, and by the bottom edge 10*b* is meant the edge of said surface 10*a* facing the opposite direction.

As shown in FIG. 7, the formation 20 is in general an uneven member or surface portion, and a recess in particular.

In alternative embodiments said uneven member 20 may be a protrusion.

The uneven member 20 can be conveniently provided in an edge portion of the stop, in particular centrally in an edge portion 11*t* of the lower plate 11, as shown in FIG. 7, on the side thereof opposed to the connecting post 12.

In the embodiment shown in the drawings the recessed uneven member 20 is essentially channel-shaped, and includes a sloping surface portion 20*a* extending between two more or less parallel side surfaces 20*b*.

In the embodiment shown in the drawings the sloping surface 20*a* is inclined with respect to a direction orthogonal to the front face or upper side surface 10*a* of the stop 4.

Preferably, the uneven member 20 is provided in the end of the stop 4 which, when the latter has been affixed to the fastener tapes 2, is the top end of the stop, adjacent the elements or teeth 5, as shown in FIG. 11. This solution is beneficial because the top end portion of the stop 4 is generally harder to see and it reduces the possibility that the edges or points of the uneven member 20 may scrape that with which it may come into contact.

Figure 8:
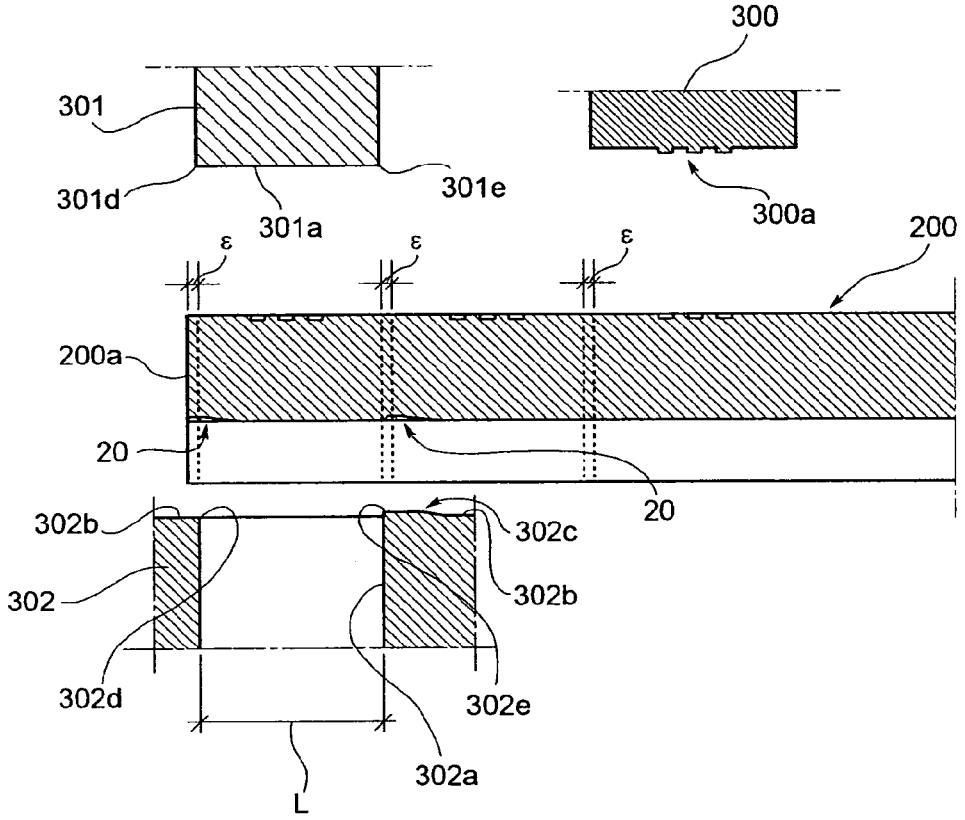
FIG. 8 is a diagrammatical representation of apparatus for the manufacture of stops according to the embodiment of FIG. 7.
Figure 9:
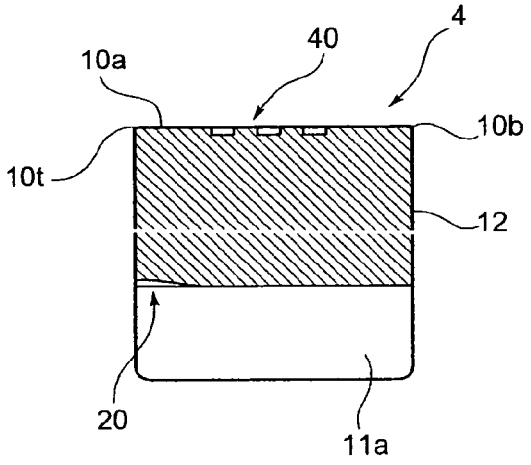
FIG. 9 is a longitudinal sectional view of a stop according to FIG. 7 manufactured with the apparatus of FIG. 8.

FIG. 8 shows an exemplary apparatus for the manufacture of stops according to FIG. 7, comprising a first press member 300 provided with a shaping surface 300*a* adapted to create a logo and/or a design 40 engraved into the front face 10*a* of the top plate of each stop 4 as shown in FIG. 9.

The apparatus of FIG. 8 comprises further an upper stamping cutting press member 301 and a cooperating lower cutting press member or die 302 provided with a hole 302*a* having a length L equal to the desired longitudinal (top to bottom) size of the stops 4.

The die 302 has an upper surface 302*b* which is generally flat, but for a protrusion 302*c* which has a shape essentially complementary to that of the uneven member 20 to be provided in the stops 4.

The protrusion 302*c* is immediately adjacent the hole 302*a* of the die 302, whereby said hole has a first sharp cutting edge 302*d* and a second sharp cutting edge 302*e* at slightly different heights or levels. Said cutting edges are longitudinally separated by the distance L.

The upper press member 301 has a generally flat lower surface 301*a*, with longitudinally opposed stamping/cutting edges 301*d* and 301*e*, longitudinally separated essentially by the distance L.

The apparatus of FIG. 8 operates essentially in accordance with the method already disclosed with reference to FIG. 6: a wire member 200 is sequentially stamped/cut to the side of the stops, so as to obtain therefrom a plurality of stops 4.

In particular, for cutting a stop 4 the wire member 200 is disposed relative to the stamping/cutting press member 301 and the cooperating die 302 in a position like that shows in FIG. 8, such that its leading end 200*a* extends above the upper surface 302*b* of said die, beyond the cutting edge 302*d* thereof by a small amount indicated $\epsilon$ in FIG. 8.

The press member 301 is then moved toward the die 302, and a stop 4 is stamped or cut away from the wire 200. In this process, a thin waste "slice" is cut away from the leading portion of the wire 200, and an uneven member 20 is created in the "new" leading portion of said wire 200 which will be subsequently stamped or cut to form the next stop 4.

Thus, at each stamping/cutting step a new stop 4 is formed, wherein the respective uneven member 20 had been provided in the immediately preceding stamping/cutting step.

Before each stamping/cutting operation, the leading end of the wire 200 is disposed, relative to the press member 301 and the die 302, in the same position described above, i.e. longitudinally beyond the cutting edge 302*d* of the hole 302 by an amount c.

Thus at each stamping/cutting step a thin waste "slice" of excess material is cut away from the leading end of the wire 200.

Such a cutting process guarantees that the thus obtained stops 4 are provided with sharp upper top and bottom edges 10*t*, 10*b* (FIG. 9).

The above-described process is moreover such that the top edge portion 11*t* and the lower bottom edge portion of the thus obtained stops 4 are instead rounded.

However, by reversing the position of the wire 200 between the press member 301 and the die 302, a rounded cut would be obtained at the top and bottom edges 10*t*, 10*b* of the front face 10*a* of the stops, and sharp cuts would be obtained at the top edge portion 11*t* and the lower bottom edge portion.

With the above stamping/cutting process, the provision of the logo and/or design 40 on the front face of the stops 4 can be carried out before or after the stops 4 have been severed out from the wire member 200. The press member 301 might also be provided with a shaping surface adapted to engrave the logo and/or design 40 into each stop 4 while this is being stamped/cut away from the wire member 200.

Figure 10:
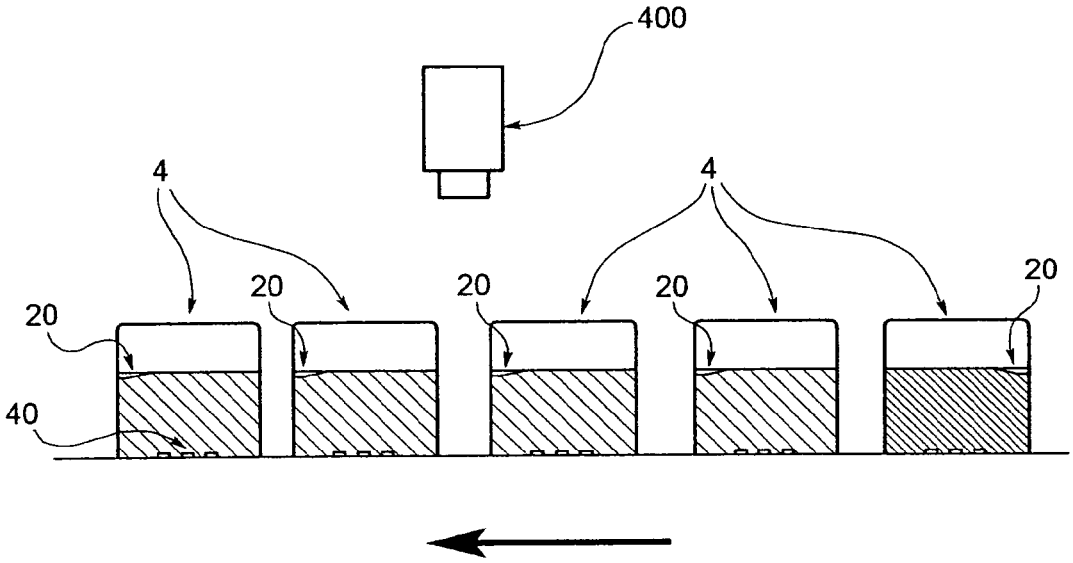
FIG. 10 is a diagrammatical representation of apparatus for detecting incorrectly oriented stops of the kind according to FIGS. 7 and 9.

Finally, FIG. 10 shows a simple diagram of a process for identifying whether each bottom stop 4 in a row is oriented in the correct position or not, before the attachment thereof to the stringers of a fastener.

In FIG. 10 a row of stops 4 are imagined to flow from the right to the left from a feeder (not shown, but known per se) to a mechanism for attaching them to corresponding slide fasteners. A sensor 400 of a known type, such as a CCD camera, is used to scan the row of flowing stops 4, to determine whether they are oriented correctly or not. In FIG. 10 the rightmost bottom stop 4 is oriented wrongly, and this may be detected from the signals provided by the sensor 400. To that end, the sensor 400 can be a relatively cheap light sensor: a light beam impinging on the sloping surface 20*a* of the uneven member 20 of a wrongly oriented stop 4 will not reflect back into a collection/sensing point on the sensor because of the deflection of the light beam by the slope.

Naturally, the principle of the invention remaining the same, various details may be varied with the respect to what has been described above and illustrated in the drawings, without departing thereby from the scope of the invention as defined in the annexed claims.

Thus, for instance, an additional and different material can be attached to the upper side of the top plate 10.

Different designs can be created by plating effects on the metal, either by addition or removal of a coating or a colouring.

The upper surface 10*a* of the top plate 10 does not have to be entirely flat.

As to the metal used for the manufacture of the stop, aluminum and aluminum alloys, copper and copper alloys, zinc and zinc alloys can be advantageously taken into consideration. Aluminum (or alloys thereof) and copper (or alloys thereof) are most convenient for use in the claimed method.

The shape of the stop below the design-carrying upper surface can be a profile.

A better quality of a logo or design stamped onto the stop can be achieved when the logo or design is impressed prior to cutting the rolled blank wire member in the claimed method, as the "plastic flow" of the metal will prevent any unwanted deformation of the leg members of the stop.

The invention claimed is:

1. A stop for a slide fastener, comprising a top plate and a bottom plate linked with one another at a transversely intermediate position by an integral connecting post, wherein in a condition before the stop is crimped onto the slide fastener, an upper side of the top plate is substantially flat and a lower side of the top plate is flat;

and the bottom plate includes a pair of leg members which slope away from the connecting post, wherein the stop is crimped onto fastener tapes of the slide fastener by deforming the pair of leg members of the bottom plate without substantially deforming the top plate, and wherein in a condition after the stop is crimped onto the slide fastener, the pair of leg members are provided with a respective end flange pointing towards the top plate and adapted to cooperate in use with the top plate to retain the fastener tapes therebetween, wherein in the condition after the stop is crimped onto the slide fastener, an upper side of each of the leg members of the bottom plate has a sloping surface extending from the respective flange towards a proximal portion of each of the leg members, and wherein the bottom plate is shaped such that in the condition after the stop is crimped onto the slide fastener an entire lower side of the bottom plate is flat.

2. The stop according to claim 1, wherein in the condition after the stop is crimped onto the slide fastener, the upper side of each of the leg members forms a recess having an essentially trapezoid profile.

3. The stop according to claim 1, wherein in the condition before the stop is crimped onto the slide fastener the upper side of the top plate is stamped or impressed with a logo or a design.

4. The stop according to claim 1, wherein the stop is formed by pressure rolling a wire member.

5. The stop according to claim 1, wherein an uneven member is formed on the lower side of the bottom plate thereof, allowing to distinguish established top and bottom edges of the top plate of the stop.

6. The stop according to claim 5, wherein the uneven member is formed in an edge portion of one end of the stop.

7. The stop according to claim 6, wherein the uneven member is formed centrally in the bottom plate, on the lower side thereof opposed to the connecting post.

8. The stop according to claim 5, wherein the uneven member has a sloping surface inclined with respect to a predetermined direction.

9. A method of detecting whether the stop according to claim 5 is oriented in a predetermined manner, comprising forming the uneven member on a rear side of the stop allowing to establish top and bottom edges of the top plate of the stop, and optically scanning the rear side of the stop to provide signals allowing to determined whether the top and bottom edges are disposed in a predetermined relative position depending on a position of the uneven member.

10. A slide fastener comprising a pair of fastener stringers each comprising the fastener tape provided with a respective row of fastener elements at its edge, a slider for engaging and disengaging the fasteners elements, and the stop according to claim 1, attached to the fastener tapes at one end of the rows of the fastener elements.

11. The slide fastener according to claim 10, wherein the stop has an uneven member formed on a rear side on the stop, allowing to distinguish established top and bottom edges of the top plate of the stop, the uneven member being adjacent the fastener elements.

12. A method for forming a plurality of stops according to claim 1, comprising pressure rolling a wire member into a desired cross-sectional shape, and cutting the wire member to a size of the stops.

13. The stop according to claim 1, wherein the upper side of the top plate has sharp top and bottom edges, and the lower side of the bottom plate has rounded top and bottom edges.

14. The stop according to claim 1, wherein in the condition before the stop is crimped onto the slide fastener, the sloping surface is substantially parallel with respect to the lower side of the top plate.

15. A stop for a slide fastener, comprising a top plate and a bottom plate linked with one another at a transversely intermediate position by an integral connecting post, wherein a condition before the stop is crimped onto the slide fastener, an upper side and a lower side of the top plate are substantially flat; and the bottom plate includes a pair of leg members which slope away from the connecting post, wherein the stop is crimped onto fastener tapes of the slide fastener by deforming the pair of leg members of the bottom plate without substantially deforming the top plate, wherein in a condition after the stop is crimped onto the slide fastener, the pair of leg members are provided with a respective end flange pointing towards the top plate and adapted to cooperate in use with the top plate to retain fastener tapes therebetween, and wherein in the condition before the stop is crimped onto the slide fastener, a proximal portion of each of the leg members of the bottom plate forms a convex protrusion adjacent the connecting post.

* * * * *